United States Patent [19]

Wander

[11] 3,994,414

[45] Nov. 30, 1976

[54] SEALING STRIP GUIDE

[76] Inventor: Monte M. Wander, 16242 Plummer St., Sepulveda, Calif. 91343

[22] Filed: Mar. 4, 1976

[21] Appl. No.: 663,872

[52] U.S. Cl. ..... 220/275
[51] Int. Cl.[2] ..... B65D 45/32
[58] Field of Search ..... 220/274, 275

[56] References Cited

UNITED STATES PATENTS

| | | | |
|---|---|---|---|
| 2,723,047 | 11/1955 | Sorensen | 220/275 |
| 3,079,036 | 2/1963 | Schnabolk | 220/275 |

*Primary Examiner*—George T. Hall
*Attorney, Agent, or Firm*—Nilsson, Robbins, Dalgarn & Berliner

[57] ABSTRACT

A sealing strip guide which is utilized in combination with a container having a sealing strip thereabout and a key which engages the sealing strip to remove the same from the container to thereby open it. The guide is an enclosed unitary member having one open side with slots extending from the open side edges in opposed side walls for receiving the key therein. One side edge and a portion of the end walls projects beyond the other side edge and remainder of the open walls to provide a notched or recessed portion to accomodate the bead which extends around the upper edge of most containers employing a sealing strip. The inner face of the side wall adjacent the recessed portion includes an inclined surface portion for assisting in guiding the sealing strip into the interior of the sealing strip guide as the strip is removed from the container.

9 Claims, 7 Drawing Figures

SEALING STRIP GUIDE

BACKGROUND OF THE PRIOR ART

Containers of the type adapted to be opened by removal of a sealing strip with a key are well known in the prior art. As the metallic sealing strip is removed from the container it is coiled upon itself by the winding action of the key. However, as a result of the resiliency of the metal it is often difficult to maintain alignment of the coils of the sealing strip thus causing the sealing strip to become disengaged. That is, when the coil windings are no longer concentric upon themselves, the metallic sealing strip may be twisted which causes premature breaking (and thus a partially open container). Alternatively such misalignment adds difficulty in completing the opening of the container and sometimes results in injury to the one attempting to open the container. Difficulty in opening the container through removal of the sealing strip may also occur as a result of the key being tilted thus causing the same to rotate at an angle as the strip is removed from the can or other type container. Again the strip may break or the coils thereof become misaligned with the results as above pointed out.

There are various sizes and shapes of containers such as cylindrical, rectangular, pear shaped or the like depending upon the contents and the particular manner in which the contents are processed. Prior art guides for sealing strips have typically been incapable of being utilized with all varieties of style and shape of container.

The best known prior art relating to sealing strip guides is contained in the following U.S. Pat. Nos. 1,911,613; 2,572,820; 2,723,047; 2,755,957; 2,784,866; 2,795,351; 2,942,755; 3,079,036 and 3,130,858.

SUMMARY OF THE INVENTION

A sealing strip guide for use with a key to remove a sealing strip from a container to open the same and including a pair of side walls and a pair of end walls defining an outer edge. One of the side walls, along with part of the end walls, projects beyond the remainder of the outer edge and each of the side walls defines a slot to receive the key.

DESCRIPTION OF THE DISCLOSED EMBODIMENT

Figure 1:
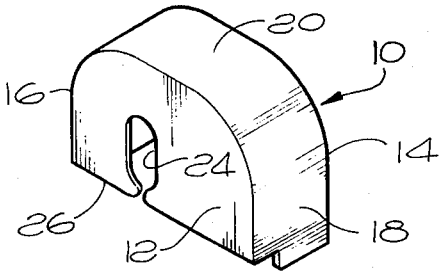
FIG. 1 is a perspective view of a sealing strip guide constructed in accordance with the principles of the present invention.
Figure 2:
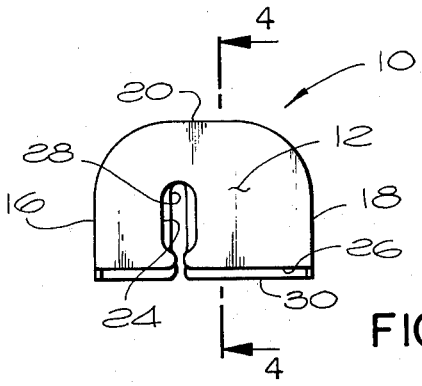
FIG. 2 is a front elevational view of the apparatus as illustrated in FIG. 1.
Figure 3:
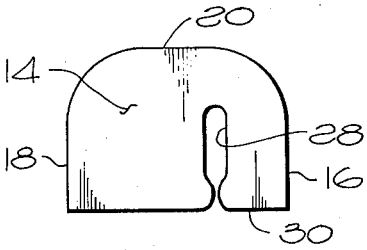
FIG. 3 is a rear elevational view thereof.

It has been discovered that there is a great deal of variation in the dimensions between the top edge of the sealing strip and the bottom edge of the bead on top of the container from manufacturer to manufacturer of such containers. This variation caused many prior art guides for sealing strips to be inoperable. Such resulted because when placed in position upon the container a side edge thereof would rest upon the sealing strip and in operation the sealing strip would shear off before it could be removed from the container. Such inoperability resulted because the two side walls of the sealing strip were of the same length thus causing the side edge to necessarily rest beneath the bead on top of the can. Alternatively, if the side edge was made to grip the bead (as shown in U.S. Pat. No. 3,079,036) then precise alignment between the sealing strip and the bead was required for the guide to work properly. Thus, an apparatus of this type was useful at best on only a limited number of containers.

Applicant's sealing strip guide solves the foregoing problems by providing a structure having a notched or recessed side edge for properly positioning the sealing strip guide relative to the sealing strip without interference from the bead on the can to make the sealing strip guide truly universally usable with all known containers utilizing sealing strips.

By reference now to FIGS. 1 through 4, applicant's sealing strip guide is shown in greater detail. As is therein illustrated the guide 10 is an enclosed member having first and second side walls 12 and 14 respectively, first and second end walls 16 and 18 respectively, and a top wall 20. The structure thus defines one open side or entry 22 into the interior of the structure 10.

The side wall 12 defines a slot 24 extending inwardly from the edge 26. It should be noted that the slot 24 is narrower adjacent the edge 26 than throughout the remainder thereof thus providing a locking means for retaining the key in the slot 24 as will become more apparent hereinafter. The side wall 14 also defines a slot 28 extending inwardly from the edge 30 and again as will be noted the slot 28 is narrower adjacent the edge 30 than throughout the remainder thereof. It should also be noted that the slot 28 is narrower than the slot 24, the slot 28 being designed to receive the end portion 32 of the key 34 (as better seen in FIG. 7) while the slot 24 is adapted to receive the body of the key 34 which is wider than is the end portion 32 thereof.

Figure 4:
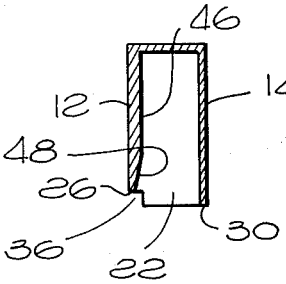
FIG. 4 is a cross-sectional view taken about the lines 4—4 of FIG. 2.

As will be more easily seen with reference to FIG. 4, the side wall 14 along with a portion of the end walls 16 and 18 projects beyond the side wall 12 and the remainder portion of the end walls 16 and 18. This projection effectively provides a recess or notch 36 for a purpose to be more fully described below.

Figure 5:
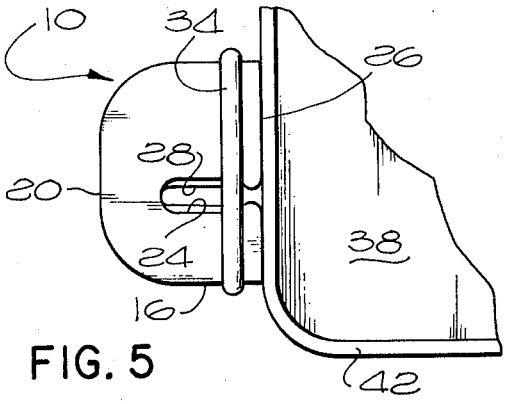
FIG. 5 is a fragmentary top plan view illustrating the sealing strip guide of the present invention in place upon a container.
Figure 6:
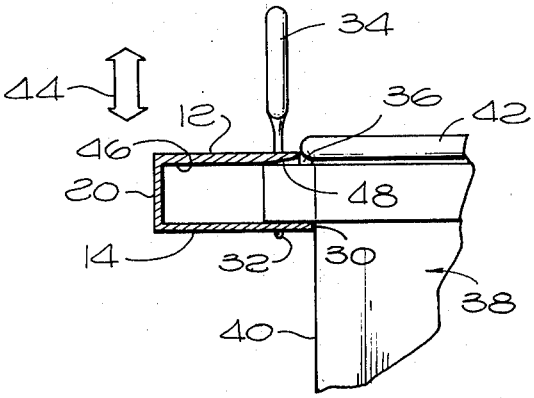
FIG. 6 is a fragmentary side elevational view, partly in cross section, illustrating the sealing strip guide in place upon the container as shown in FIG. 5 and at the beginning of the removal of the sealing strip.
Figure 7:
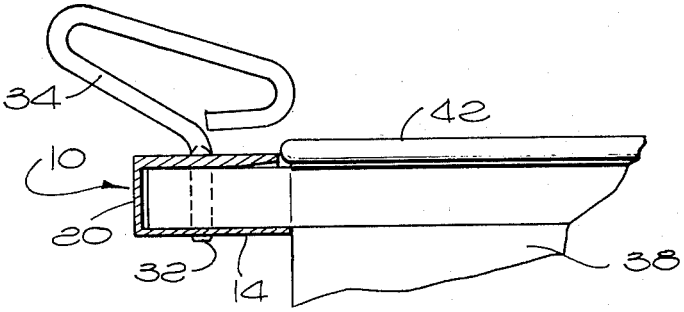
FIG. 7 is similar to FIG. 6 but showing the sealing strip almost completely removed.

In utilization of the sealing strip guide constructed in accordance with the present invention, the end of the sealing strip is bent upwardly from the container as is well known. The end of the strip is fitted through the opening in the key and the key is then wound for one or two turns to secure the key to the strip. Thereafter, the key is unwound a short distance and the guide constructed in accordance with the present invention is snapped onto the key with the large slot facing the handle of the key as is shown in FIGS. 5 through 7.

Thus it will be noted that the edge 30 of the side wall 14 is resting against the edge 40 of the container 38. As will become apparent from FIGS. 6 and 7 the notch or recess 36 provided by the projecting side wall 14 permits the bead 42 on the can or container 38 to be received therein. Since the notch 36 is formed deeply enough in the end walls 16 and 18 various size beads may be received thus permitting the guide to move laterally as illustrated by the arrow 44 without interference from the bead 42 thus positioning itself to easily receive the sealing strip as the same is removed from the container 38.

When the guide 10 is snapped onto the key it will be appreciated by those skilled in the art that the key is forced through the narrow opening to slots 24 and 28. Thereafter the key is held in place in the slots by the narrow openings throughout removal of the sealing strip from the container. The inner surface 46 of the side wall 12 has an inclined surface portion 48 which extends from the edge 26 upwardly and inwardly along the inner face 46. This inclined surface portion 48 effectively operates as a camming surface to assist the guide in properly aligning itself to receive the metal sealing strip as the same is removed from the container 38. That is, even though the guide 10 may be misaligned with respect to the sealing strip as the removal operation begins, the sealing strip bearing against the camming surface 48 moves the guide 10 as shown by the arrow 44 and allowed by the recess 36 therefore permitting removal of the sealing strip and retention thereof in the guide 10 irrespective of positioning between the bead 42 and the sealing strip.

Thus with the structure as illustrated and above described, as the key 34 is rotated about the container 38 the side walls 12 and 14 of the guide retain the concentric band of the sealing strip in position upon the key until the strip is totally removed from the container. Thereafter the key with the sealing strip wound thereon is snapped from the openings 24 and 28 of the guide and discarded. Thereafter the guide may be reused as desired upon other containers to remove the sealing strips therefrom.

As will be appreciated by those skilled in the art, the slots 24 and 28 are offset from the center line of the guide 10. This offset prevents the guide from rotating as the key removes the sealing strip from the container.

It will be recognized by those skilled in the art that the sealing strip guide constructed in accordance with the present invention may be unitarily formed by molding the same from plastic of various types. Alternatively, the sealing strip guide may be manufactured from any material desired depending upon the particular application involved. It will also be recognized that although a can having a generally rectangular shape is illustrated in FIG. 5, that any shape container may be opened so long as the same is sealed with a sealing strip designed for removal.

What is claimed is:

1. A sealing strip guide for use in combination with a key for removing a sealing strip from a can thereby to open the can, said guide comprising;

A. a pair of side walls and a pair of end walls defining an outer edge;

B. one of said side walls and a contiguous portion of said pair of end walls projecting beyond the remainder of said end walls and the other side wall;

C. each of said side walls defining a slot extending inwardly from said outer edge thereof for receiving said key.

2. A sealing strip guide as defined in claim 1 wherein each of said slots is narrower adjacent said edge than throughout the remainder thereof for effectively locking said key in said slots during removal of said sealing strip.

3. A sealing strip guide as defined in claim 1 wherein said other side wall includes an inclined inner surface adjacent said outer edge for guiding said sealing strip into said guide.

4. A sealing strip guide as defined in claim 1 which further includes a top wall thereby providing an enclosed housing for receiving said sealing strip.

5. A sealing strip guide as defined in claim 4 wherein said slots are offset in the same direction from the center of said sidewalls.

6. A sealing strip guide for use in combination with a key for removing a sealing strip from a can thereby to open the can, said guide comprising:

A. first and second spaced apart opposed side walls having first and second edges and first and second opposed faces respectively;

B. means for retaining said side walls in said spaced apart position;

C. said first edge projecting beyond said second edge;

D. said second face having an inclined portion adjacent said second edge; and

E. each of said side walls defining a slot extending inwardly from said edges for receiving said key.

7. A sealing strip guide as defined in claim 6 wherein said means for retaining includes a pair of end walls and a top wall formed unitarily with said side walls.

8. A sealing strip guide as defined in claim 7 wherein each of said slots is narrower adjacent said edge than throughout the remainder thereof for effectively locking said key in said slots during removal of said sealing strip.

9. A sealing strip guide as defined in claim 8 wherein each of said slots is offset in the same direction from the center of each of said side walls.

* * * * *